US005363019A

United States Patent [19]

Itatani et al.

[11] Patent Number: 5,363,019

[45] Date of Patent: Nov. 8, 1994

[54] VARIABLE COLOR DISCHARGE DEVICE

[75] Inventors: Ryohei Itatani, Kyoto; Masatoshi Ryoko, Hyogo; Tatsushi Fujino, Kakogawa, all of Japan

[73] Assignee: Research Institute For Applied Sciences, Kyoto, Japan

[21] Appl. No.: 953,100

[22] Filed: Sep. 29, 1992

[30] Foreign Application Priority Data

May 1, 1992 [JP] Japan ..... 4-157231

[51] Int. Cl.[5] ..... G09G 3/10

[52] U.S. Cl. ..... 315/169.1; 315/248; 315/326; 315/DIG. 5

[58] Field of Search ..... 315/169.1, 248, 207, 315/291, 317, 326, 209 R, DIG. 5, DIG. 7; 313/225, 227, 229, 493, 607, 622

[56] References Cited

U.S. PATENT DOCUMENTS

| | | | |
|---|---|---|---|
| 4,237,401 | 12/1980 | Couwenberg | 313/225 |
| 4,740,729 | 4/1988 | Chow | 315/169.1 X |
| 4,963,796 | 10/1990 | Gottschling et al. | 315/246 |
| 5,034,661 | 7/1991 | Sakurai et al. | 315/207 |

FOREIGN PATENT DOCUMENTS 53-42386 11/1978 Japan .

OTHER PUBLICATIONS

Dictionary of Electronics by Rudolf Graf, Radio--Shack 1974–1975, p. 248.

Record of the 1991 Kansai-Section Joint Convention of Institutes of Electrical Engineering, Japan, Sep. 30, 1991, No. G13-9, Masatoshi Ryoko, et al., "Discharge Luminous Color Control Utilizing Negative Glow" (with partial English translation).

Proceedings of 1992 Annual Conference of the Illuminating Engineering Institute of Japan, Mar. 17, 1992, p. 7, Tatsushi Fujino, et al., "Negative Glow-Type Multi--Colored Discharge Lamp Using Ito Transparent Electrode" (with partial English translation).

Papers of the 7th Technical Meeting On Light Source Properties and Application Thereof; the Illumination Engineering Institute of Japan and the Japan Society of Applied Physics, Jul. 20, 1992, pp. 90-95, Tatsushi Fujino, et al., "Negative Glow-Type Multi-Colored Discharge Lamp" (with partial English translation).

Papers of Technical Meeting On Plasma, No. EP-73-2, Jun. 25, 1973, R. Itatani, et al., "Control of Luminous Color of Discharge".

*Primary Examiner*—Robert J. Pascal
*Assistant Examiner*—Haissa Philogene
*Attorney, Agent, or Firm*—Oblon, Spivak, McClelland, Maier & Neustadt

[57] ABSTRACT

A discharge tube including a tubular vessel which is filled with gases, and including a first gas and second gas, the first and second gases being different in excitation level and luminous color from each other. A first electrode unit axially applies an electric field to the vessel to generate a positive column in the vessel. A second electrode unit applies an electric field to the vessel to generate a negative glow in an area, the area extending substantially along a wall surface of the vessel and confronting the positive column generated by the electric field applied by the first electrode.

29 Claims, 4 Drawing Sheets

VARIABLE COLOR DISCHARGE DEVICE

BACKGROUND OF THE INVENTION

The present invention relates to a discharge tube which is capable of changing a luminous color and a discharge device employing the same, and can be, for example, applied to an illuminating lamp, a neon sign, a display lamp and the like which are installed indoors and outdoors.

It has heretofore been considered that the luminance color accompanying gas discharge is uniquely determined in correspondence to the kind of the gas (including vapor) and thus it is impossible to change the luminous color.

On the other hand, one of the present inventors invented a method wherein pulsed discharge is generated using a discharge tube of normal type, and the width, period, rise time and the like of the pulse are changed to control the electron energy within the discharge tube, thereby to change the luminous color of a positive column to change the luminous color of the discharge tube (refer to JP-B-53-42386 and Papers of Technical Meeting on Plasma (No. EP-73-2) entitled "Control of Luminous Color of Discharge" by Ryohei Itatani et al. issued on Jun. 25, 1973 by THE INSTITUTE OF ELECTRICAL ENGINEERS OF JAPAN). In this method, however, since the pulsed discharge is utilized to change the width, period, rise time and the like of the pulse, there arises problems in that a special power source is required, large noise occurs, the power efficiency is reduced, and the loads on the electrodes are large.

Incidentally, the above method is based on a standpoint in that since the luminous color of the discharge tube depends on only the luminous color of the positive column, and the light emission from the negative glow can not be utilized for the luminous color of the discharge tube, the rays radiated from the negative glow should be blocked off as much as possible so as not to leak out.

SUMMARY OF THE INVENTION

It is therefore an object of the present invention to provide a discharge tube which is capable of changing a luminous color and a discharge device employing the same.

It is another object of the present invention to provide a discharge tube in which the width, period, rise time and the like of a pulse are not necessarily changed by utilizing the pulsed discharge, and a discharge device employing the same.

In order to attain the above objects, a discharge tube according to an aspect of the present invention includes: a tubular vessel; filled gases (sealed gases) filled in the vessel and including a first gas and a second gas, the first and second gases being different in excitation level and luminous color from each other; a first electrode unit for applying axially an electric field to the vessel to generate a positive column in the vessel; and a second electrode unit for applying an electric field to the vessel to generate a negative glow in an area, the area extending substantially along a wall surface of the vessel and confronting the positive column generated by the electric field applied by the first electrode unit.

According to the present discharge tube, when the first electrode unit is supplied with the electric power, the positive column is generated in the vessel. Since the magnitude of the electric field is small in the positive column, the electron energy is small in the positive column. Therefore, in the positive column, only the gas having a lower excitation level out of the first and second gases can radiate rays, so that the luminous color from the gas having lower excitation level becomes a luminous color of the discharge tube. On the other hand, when the second electrode unit is supplied with the electric power, the negative glow is generated in the above-mentioned area. Since the magnitude of the electric field is large in the negative glow, the electron energy is large in the negative glow. Therefore, in the negative glow, both the first and second gases can radiate rays, so that a mixed color of the luminous color of the first gas and that of the second gas becomes a luminous color of the discharge tube. Further, when both the first and second electrode units are supplied with the electric power, since the positive column confronts the negative glow, a mixed color of the luminous color provided by the positive column and that provided by the negative glow becomes a luminous color of the discharge tube. Incidentally, in the case where both the first and second electrode units are supplied with the electric power, the mixture ratio of the luminous color by the positive column and that by the negative glow can be controlled by controlling suitably the level of the electric power supplied to both the first and second electrode units, whereby the luminous color of the discharge tube can be set to an arbitrary color between the luminous color by the positive column and that by the negative glow. Thus, according to the present discharge tube, by selecting a state in which the electric power is supplied to one of the first and second electrode units, or a state in which the electric power is supplied to both the first and second electrode units, it is possible to change the luminous color of the discharge tube. Then, according to the present discharge tube, as described above, since the luminous color of the discharge tube is changed by utilizing the luminous color of the negative glow as well as that of the positive column which is different in color therefrom, the width, period, rise time and the like of the pulse are not necessarily changed by utilizing the pulsed discharge. For example, the electric power of D.C. or sine wave can be supplied to the first and second electrode units. In this case, unlike the above-mentioned prior art method, it is possible to solve the problems such as necessity of the provision of the special power source, occurrence of the large noise, reduction of the efficiency of the power supply, and the large loads on the electrodes.

The excitation level of the first gas may be lower than that of the second gas, and the partial pressure of the first gas may be lower than that of the second gas. In this case, the number of atoms of the second gas of higher excitation level is larger, and thus the luminous color provided by the negative glow is near the luminous color of the second gas. Therefore, this is desirable because the difference between the luminous color provided by the negative glow and that provided by the positive column becomes large.

The first gas may be mercury vapor and the second gas may be a neon gas. In this case, the partial pressure of the first gas may be in the range of $10^{-4}$ to 1 Torr, and the partial pressure of the second gas may be in the range of 1 to 100 Torr.

A part of the vessel which corresponds in position to the positive column, which is generated by the electric field supplied by the first electrode unit, may be at least light-transmissive.

An inner surface of the vessel may be coated with a fluorescent substance for converting ultraviolet rays radiated from the first gas and/or the second gas into visible rays.

The first electrode unit may include at least two first electrodes, and the second electrode unit may include at least two second electrodes.

One of the at least two first electrodes and one of the at least two second electrodes may be used in common as a single electrode. On the other hand, the at least two first electrodes may be provided independently of the at least two second electrodes.

The shortest distance between the at least two first electrodes may be more than or equal to 1 mm.

The shortest distance between the at least two second electrodes may be in the range of 0.1 mm to 20 cm. In this case, when the second electrode unit is supplied with the electric power, the positive column may be difficult to be generated by the supply of the electric power to the second electrode unit. Therefore, in the luminous color which is provided by the supply of the electric power to the second electrode unit, the luminous color provided by the negative glow is predominant. As a result, the difference between the luminous color by the power supply to the first electrode unit and that by the power supply to the second electrode unit becomes larger. This is desirable.

The at least two first electrodes may be provided in the vessel or on an outer surface of the vessel.

At least one of the at least two second electrodes may be provided in the vessel, and the rest of the at least two second electrodes may be provided on the outer surface of the vessel. Moreover, at least one of the at least two second electrodes may be provided on an inner surface of the vessel, and the rest of the at least two second electrodes may be provided on the outer surface of the vessel. Further, the at least two second electrodes may be provided on the outer surface of the vessel, or on the inner surface of the vessel.

The at least two second electrodes may be light-transmissive or may be made of metal. When the at least two second electrodes are made of metal, the at least two second electrodes may be provided in such a way that all of the rays which are radiated from the positive column generated by the electric field applied by the first electrode unit to the outside, and all of the rays which are radiated from the negative glow generated in the area corresponding in position to the positive column to the outside are not blocked off.

A discharge device according to another aspect of the present invention includes a discharge tube. The discharge tube includes: a tubular vessel; filled gases filled in the vessel and including a first gas and a second gas, the first and second gases being different in excitation level and luminous color from each other; a first electrode unit for applying axially an electric field to the vessel to generate a positive column in the vessel; and a second electrode unit for applying an electric field to the vessel to generate a negative glow in an area, the area extending substantially along a wall surface of the vessel and confronting the positive column generated by the electric field applied by the first electrode unit. The discharge device further includes a power unit, and a control unit for controlling the power supply from the power unit to the first and second electrode units.

The control unit may select at least two states out of a state in which only the first electrode unit is supplied with the electric power, a state in which only the second electrode unit is supplied with the electric power, and a state in which both the first and second electrode units are supplied with the electric power.

The power unit may supply the electric power, which has one or two frequencies in the range of D.C. to a high frequency, to the first and second electrode units.

A discharge tube according to still another aspect of the present invention includes: a tubular vessel; filled gases filled in the vessel and including a first gas and a second gas, the first and second gases being different in excitation level and wavelength of radiated ultraviolet rays from each other; a first electrode unit for applying axially an electric field to the vessel to generate a positive column in the vessel; and a second electrode unit for applying an electric field to the vessel to generate a negative glow in an area, the area extending substantially along a wall surface of the vessel and confronting the positive column generated by the electric field applied by the first electrode unit. The inner surface of the vessel is coated with a first fluorescent substance for converting mainly ultraviolet rays radiated from the first gas into first visible rays, and a second fluorescent substance for converting mainly ultraviolet rays radiated from the second gas into second visible rays which are different in wavelength from the first visible rays.

The present discharge tube and the above-mentioned discharge tube of the second aspect are different from each other in that in the present discharge tube, the ultraviolet rays which have been radiated from the first and second gases are converted into the first and second visible rays which are different in wavelength from each other by the first and second fluorescent substances, respectively, whereas the above-mentioned discharge tube depends on that the first and second gases directly radiate the visible rays. However, the principle of changing the luminous color of the discharge tube is common to both the discharge tubes.

The first gas may be mercury vapor, and the second gas may be a xenon gas.

A discharge tube according to yet another aspect of the present invention includes: a tubular vessel; filled gases filled in the vessel and including a first gas and a second gas, the first and second gases being different in excitation level and wavelength of radiated ultraviolet rays from each other; a first electrode unit for applying axially an electric field to the vessel to generate a positive column in the vessel; and a second electrode unit for applying an electric field to the vessel to generate a negative glow in an area, the area extending substantially along a wall surface of the vessel and confronting the positive column generated by the electric field applied by the first electrode unit. The inner surface of the vessel is coated with a first fluorescent substance for converting mainly ultraviolet rays radiated from the first gas into first visible rays, and a second fluorescent substance for converting ultraviolet rays radiated from both the first and second gases into second visible rays which are different in wavelength from the first visible rays.

The present discharge tube and the above-mentioned discharge tube of the second aspect are different from each other in that in the present discharge tube, the ultraviolet rays which have been radiated from the first gas are converted into the first visible rays by the first fluorescent substance and also the ultraviolet rays which have been radiated from both the first and second gases are converted into the second visible rays by the second fluorescent substance, whereas the above discharge tube depends on that the first and second gases directly radiate the visible rays. However, the principle of changing the luminous color of the discharge tube is common to both the discharge tubes.

The first gas may be mercury vapor, and the second gas may be a xenon gas.

A discharge tube according to a further aspect of the present invention includes: a tubular vessel; filled gases filled in the vessel and including a first gas and a second gas, the first and second gases being different in excitation level from each other, the first gas radiating mainly visible rays, the second gas radiating mainly ultraviolet rays; a first electrode unit for applying axially an electric field to the vessel to generate a positive column in the vessel; and a second electrode unit for applying an electric field to the vessel to generate a negative glow in an area, the area extending substantially along a wall surface of the vessel and confronting the positive column generated by the electric field applied by the first electrode unit. The inner surface of the vessel is coated with a fluorescent substance for converting the ultraviolet rays radiated from the second gas into visible rays which are different in wavelength from the visible rays radiated from the first gas.

The present discharge tube and the above-mentioned discharge tube of the second aspect are different from each other in that the present discharge tube depends on that the first gas mainly radiates the visible rays directly, and in the present discharge tube, the ultraviolet rays radiated from the second gas are converted into the visible rays by the fluorescent substance, whereas the above discharge tube depends on that the first and second gases radiate the visible rays directly. However, the principle of changing the luminous color of the discharge tube is common to both the discharge tubes.

The first gas may be a xenon gas, and the second gas may be a neon gas.

DESCRIPTION OF THE PREFERRED EMBODIMENTS

The preferred embodiments of a discharge tube and a discharge device employing the same according to the present invention will hereinafter be described with reference to the accompanying drawings.

Figure 1:
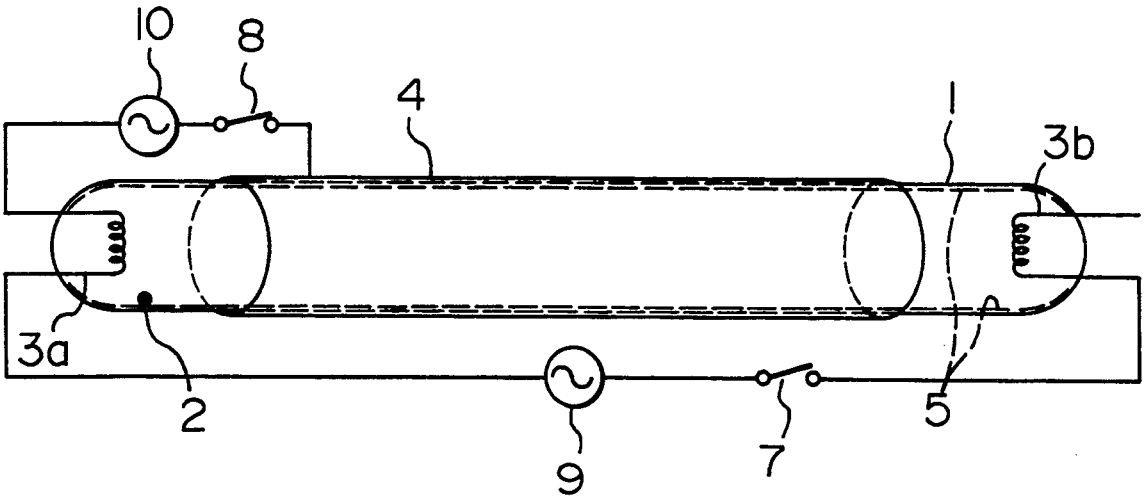
FIG. 1 is a schematic view showing a structure of a discharge device according to one embodiment of the present invention.

FIG. 1 is a schematic view showing a discharge device according to one embodiment of the present invention.

The discharge device of the present embodiment includes a tubular vessel 1, filled gases (sealed gases) which are filled in the vessel 1, and electrodes 3*a*, 3*b* and 4. A glass vessel is employed as the vessel 1 and the whole vessel is light-transmissive. The vessel 1 has a straight shape in the present embodiment. Alternatively, the vessel 1 may have a curved shape. In the present embodiment, mercury vapor and a neon gas as the filled gases are filled in the vessel 1. The mercury vapor and the neon gas are different in excitation level and luminous color from each other. A drop 2 of mercury put in the vessel 1 will become the mercury vapor. The vapor pressure of the mercury vapor depends on the temperature of the inner surface of the vessel 1. The electrodes 3*a* and 3*b* are provided at both ends of the vessel 1 and in the inside of the vessel i. In the present embodiment, the electrodes 3*a* and 3*b* constitute a first electrode unit for applying axially an electric field to the vessel 1 to generate a positive column in the vessel 1. An electrode 4 is provided throughout the entire periphery of the outer surface of the vessel 1 and in an axially central part of the vessel 1. A transparent electrode is employed as the electrode 4. In order to form the transparent electrode, for example, an ITO film (Indium-Tin-Oxide film) may be employed. In the present embodiment, the electrodes 3*a* and 4 constitute a second electrode unit for applying an electric field to the vessel 1 to generate a negative glow in an area which extends substantially along a wall surface of the vessel 1 and confronts the positive column generated by the electric field applied by the first electrode unit. In the present embodiment, the electrode 3*a* is used in common by the first and second electrode units. In the present embodiment, the inner surface of the vessel 1 is coated with a fluorescent substance 5. The fluorescent substance 5 may be such a substance as to convert ultraviolet rays radiated from both the mercury vapor and the neon gas into visible rays, or may be such a substance as to convert the ultraviolet rays radiated from one of the mercury vapor and the neon gas into the visible rays. However, since the neon gas radiates the ultraviolet rays much less than the mercury vapor, the fluorescent substance 5 may preferably be a substance as to convert mainly the ultraviolet radiated from the mercury vapor into the visible rays. The inner surface of the vessel 1 may not be coated with the fluorescent substance 5. Incidentally, in the case where the ITO film is provided to form the electrode 4, if the resistance of the ITO film is relatively large, it is preferable that a strip metallic foil or the like is formed on the ITO film and along the axial direction of the vessel 1 in such a way that the uniform electric potential of the electrode 4 is obtained in each part as much as possible.

A power source 9 is connected through a switch 7 between the electrodes 3*a* and 3*b*, and a power source 10 is connected through a switch 8 between the electrodes 3*a* and 4. The frequency of each of the power sources 9 and 10 may be an arbitrary frequency in the range of D.C. to a high frequency. But, in the present embodiment, since the electrode 4 is provided on the outer surface of the vessel 1, it is preferable that the power source 10 is an A.C. power source. The frequency of the power source 9 may be the same as that of the power source 10, or may be different therefrom.

The power sources 9 and 10 may be replaced with a single power source.

In the discharge device having the above structure as shown in FIG. 1, when the switch 7 is closed, a positive column is generated in the vessel 1. Since the magnitude of the electric field is small in the positive column, the electron energy is small in the positive column. Therefore, in the positive column, only the gas having a lower excitation level out of the mercury vapor and the neon gas can radiate the rays, and thus luminous color of the mercury vapor having the lower excitation level becomes a luminous color of the discharge tube. On the other hand, when the switch 8 is closed, a negative glow is generated in the above-mentioned area (the area which is near the electrode 4 and extends substantially along the inner surface of the vessel 1). Since the magnitude of the electric field is large in the negative glow, the electron energy is large in the negative glow. Therefore, in the negative glow, both the mercury vapor and the neon gas can radiate the rays, and thus the mixed color of the luminous color of the mercury vapor and that of the neon gas becomes a luminous color of the discharge tube. Further, when the switches 7 and 8 are closed simultaneously, since the positive column confronts the negative glow, the mixed color of the luminous color provided by the positive column and that provided by the negative glow becomes a luminous color of the discharge tube. Incidentally, in the case where the switches 7 and 8 are closed simultaneously, the mixture ratio of the luminous color by the positive column and that by the negative glow can be controlled by controlling suitably the power level of the power source 9 or 10, whereby the luminous color of the discharge tube can be set to an arbitrary color between the luminous color by the positive column and that by the negative glow. Incidentally, in the present embodiment, as described above, the inner surface of the vessel 1 is coated with the fluorescent substance 5. Therefore, actually, the visible rays radiated by the fluorescent substance 5 are included in the rays radiated from the discharge tube.

Thus, in the discharge device shown in FIG. 1, by selecting either a state in which one of the switches 7 and 8 is closed, or a state in which both the switches 7 and 8 are closed simultaneously, the luminous color of the discharge tube can be changed. Then, in the above discharge tube, the luminous color of the discharge tube is, as described above, changed by utilizing the luminous color of the negative glow as well as that of the positive column which is different therefrom. Therefore, the width, period, rise time and the like of the pulse are not necessarily changed by utilizing the pulsed discharge. For example, the electric power of the power sources 9 and 10 can be made to be an electric power of sine wave. In this case, unlike the prior art method, it is possible to solve the problems such as necessity of the provision of the special power source, occurrence of the large noise, reduction of the efficiency of the power source, and the large loads on the electrodes.

Now, in the present embodiment, since the excitation level of the mercury vapor is lower than that of the neon gas, it is preferable that the partial pressure of the mercury vapor is lower than that of the neon gas. For example, it is preferable that the partial pressure of the mercury vapor is in the range of $10^{-4}$ to 1 Torr, and the partial pressure of the neon gas is in the range of 1 to 100 Torr. In this case, the number of atoms of the neon gas having a higher excitation level is larger, and thus the luminous color provided by the negative glow is near the luminous color of the neon gas. Therefore, this is desirable because the difference between the luminous color by the negative glow and that by the positive column becomes large.

In the present embodiment, only the mercury vapor and the neon gas are filled in the vessel 1. However, it is to be understood that in addition thereto, other gases such as a helium gas may be filled in the vessel 1.

Moreover, if the shortest distance between the electrodes 3*a* and 3*b* is made too short, the positive column may not be generated by the discharge between the electrodes 3*a* and 3*b* in some cases. For this reason, that distance is preferably set to a value more than or equal to 1 mm for example.

In the present embodiment, the whole vessel 1 is light-transmissive. However, the whole vessel 1 is not necessarily required to be light-transmissive. But, it is preferable that a part of the vessel 1 which corresponds in position to the positive column is at least light-transmissive.

Figure 2:
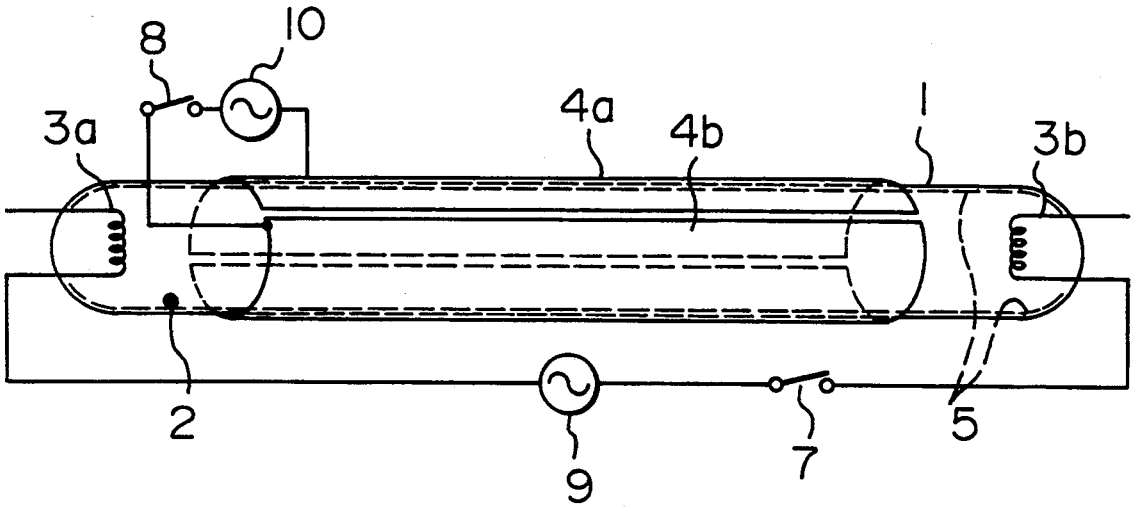
FIG. 2 is a schematic view showing a structure of a discharge device according to another embodiment of the present invention.

Next, a discharge device according to another embodiment of the present invention will hereinbelow be described. FIG. 2 is a schematic view showing the discharge device. In FIG. 2, those parts corresponding to their counterparts in FIG. 1 are represented with the same reference numerals, and the description thereof is omitted here for the sake of simplicity.

The discharge device shown in FIG. 2 is the same as the discharge device shown in FIG. 1 except that electrodes 4*a* and 4*b* are provided instead of the electrode 4, and the power source 10 is connected through the switch 8 between the electrodes 4*a* and 4*b*. In the present embodiment, the electrodes 4*a* and 4*b* constitute the second electrode unit. In the present embodiment, the electrode 3*a* is not used in common, and thus the first and second electrode units are provided independently of each other. The electrodes 4*a* and 4*b* are formed by dividing the electrode 4 of FIG. 1 into two parts. In this connection, small gaps are provided between the electrodes 4*a* and 4*b*. The size of the gap (the shortest distance between the electrodes 4*a* and 4*b*) is preferably in the range of 0.1 mm to 20 cm, and more suitably in the range of 1 to 2 mm. In this case, when the switch 8 is closed, the positive column may be difficult to be generated depending on the discharge between the electrodes 4*a* and 4*b*. Therefore, the luminous color provided by the negative glow is predominant in the luminous color provided by the discharge between the electrodes 4*a* and 4*b*. Therefore, this is desirable because the difference between the luminous color when the switch 7 is closed and the luminance color when the switch 8 is closed is large.

In the discharge device shown in FIG. 2 as well, in the same manner as in the discharge device shown in FIG. 1, the luminous color of the discharge tube can be changed.

Figure 3:
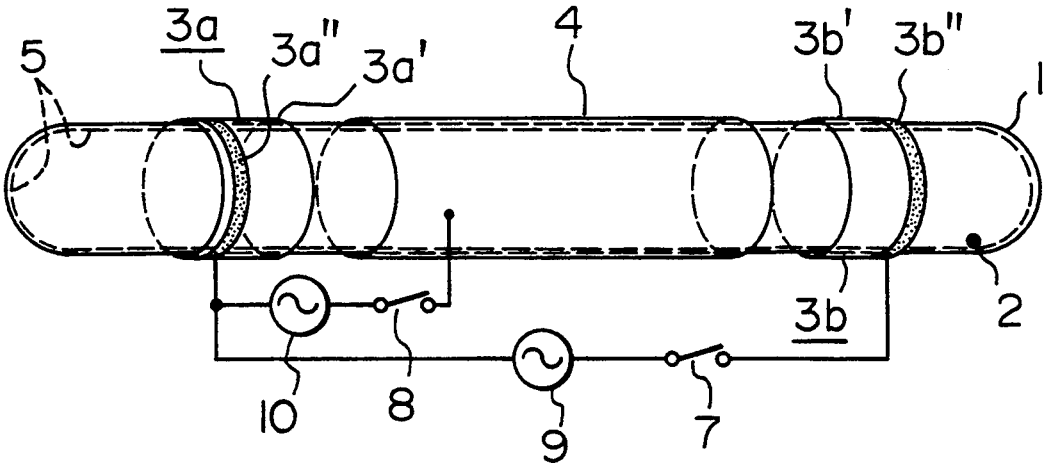
FIG. 3 is a schematic view showing a structure of a discharge device according to still another embodiment of the present invention.

Next, the description will hereinbelow be given to a discharge device according to still another embodiment of the present invention. FIG. 3 is a schematic view showing the discharge device. In FIG. 3, those parts corresponding to their counterparts in FIG. 1 are represented with the same reference numerals, and the description thereof is omitted here for the sake of simplicity.

The discharge device shown in FIG. 3 is the same as the discharge device shown in FIG. 1 except that the electrodes 3a and 3b are provided throughout the entire periphery of the outer surface of the vessel 1. In the present embodiment, the electrodes 3a and 3b are constituted of transparent electrode parts 3a' and 3b' and metallic electrode parts 3a'' and 3b'' provided on the transparent electrode parts 3a' and 3b', respectively. Alternatively, each of the electrodes 3a and 3b may be constituted of one of the transparent electrode and the metallic electrode.

In the discharge device shown in FIG. 3 as well, in the same manner as in the discharge device shown in FIG. 1, the luminous color of the discharge tube can be changed.

Figure 4:
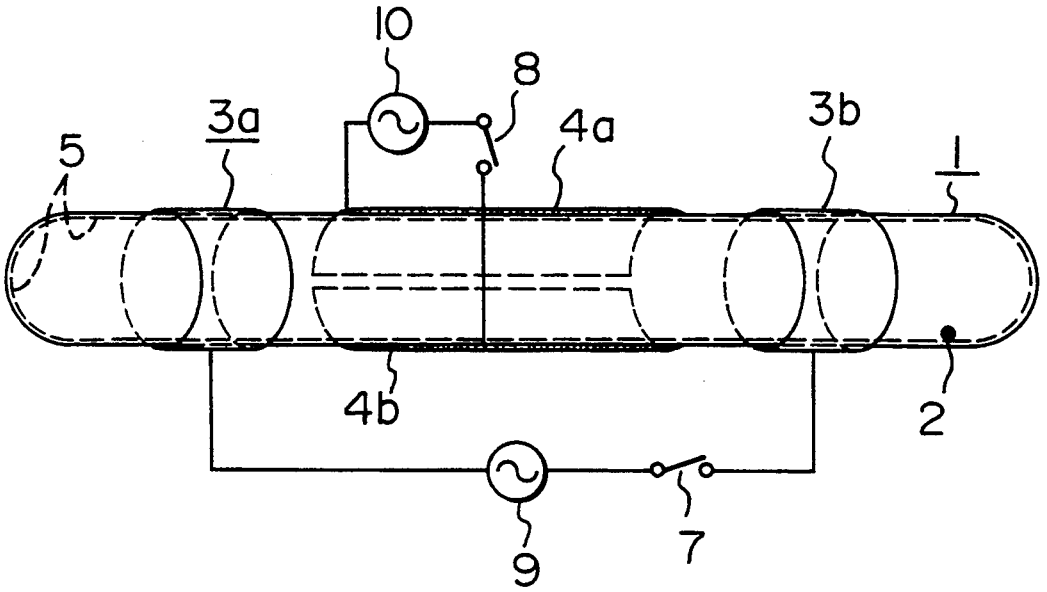
FIG. 4 is a schematic view showing a structure of a discharge device according to yet another embodiment of the present invention.

Next, the description will hereinbelow be given to a discharge device according to yet another embodiment of the present invention. FIG. 4 is a schematic view showing the discharge device. In FIG. 4, those parts corresponding to their counterparts in FIG. 1 are represented with the same reference numerals, and the description thereof is omitted here for the sake of simplicity.

The discharge device shown in FIG. 4 is the same as the discharge device shown in FIG. 1 except that the electrodes 4a and 4b are provided instead of the electrode 4, the power source 10 is connected through the switch 8 between the electrodes 4a and 4b, and the electrodes 3a and 3b are provided throughout the entire periphery of the outer surface of the vessel 1. In the present embodiment, the electrode 3a is not used in common, and thus the first and second electrode units are provided independently of each other. The electrodes 3a and 3b may be transparent electrodes or may be metallic electrodes. The electrodes 4a and 4b are provided on the outer surface of the vessel 1 in such a way that about half of the entire periphery of the outer surface of the vessel 1 is covered with both the electrodes 4a and 4b. A small gap is provided between the electrodes 4a and 4b. The electrodes 4a and 4b may be transparent electrodes or metallic electrodes. In the case where the electrodes 4a and 4b are the metallic electrodes, those metallic electrodes perform the function of a reflecting mirror.

In the discharge device shown in FIG. 4 as well, in the same manner as that in the discharge device shown in FIG. 1, the luminous color of the discharge tube can be changed.

Figure 5:
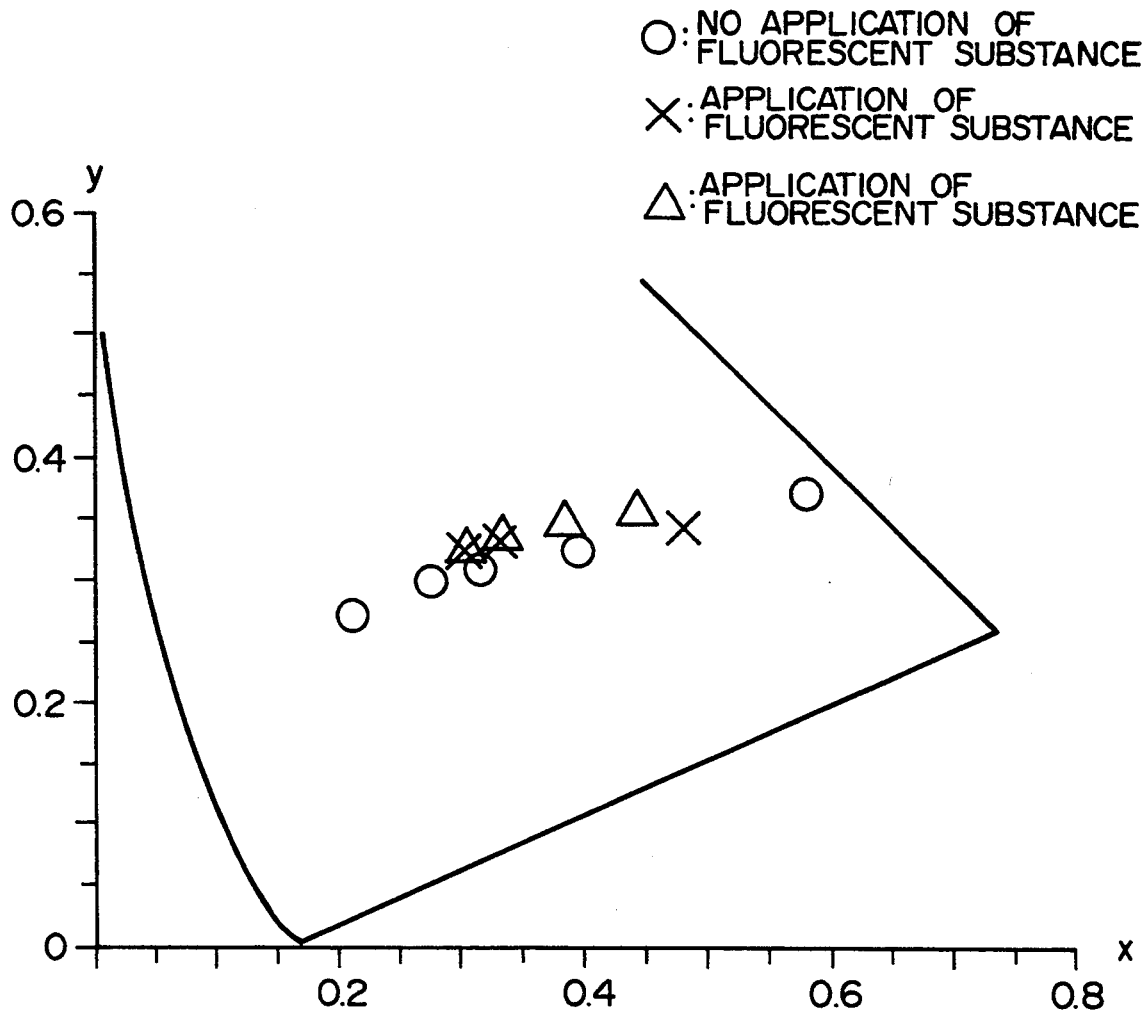
FIG. 5 is a CIE chromaticity diagram showing one example of characteristics of the discharge device according to the present invention.

FIG. 5 is a CIE chromaticity diagram showing one example of characteristics of the discharge device according to the present invention. The characteristics were obtained with respect to the under-mentioned three cases. That is, in a first case, the discharge device shown in FIG. 2 was used wherein the electrodes 3a and 3b shown in FIG. 2 were replaced with the electrodes 3a and 3b shown in FIG. 3. In this case, the vessel 1 was made of glass, and the inner diameter thereof was set to 12.5 mmϕ. The drop 2 of mercury was put in the vessel 1, and the partial pressure of the neon gas was set to 32 Torr. The ITO film was used to form the electrodes 4a and 4b. The shortest distance between the electrodes 4a and 4b was set to about 1 mm. The lengths of the electrodes 4a and 4b along the axial direction of the vessel 1 were set to 100 mm, and the lengths of the electrodes 3a and 3b along the axial direction of the vessel 1 were set to 30 mm. The distance between the electrode 3a and the electrodes 4a, 4b and the distance between the electrode 3b and the electrodes 4a, 4b were set to about 10 mm. The fluorescent substance was not applied to the inner surface of the vessel 1. A power source of 10 kHz was used as the power source 9 and a power source of 20 kHz was used as the power source 10. Then, in the first case, the voltage of the power source 10 was changed while keeping the voltage of the power source 9 at a suitable level, thereby to obtain the data represented by the mark ○ in FIG. 5. In a second case, the discharge device shown in FIG. 1 was used. As the vessel 1, the tube which is used in the normal neon filled fluorescent lamp of 15 W type was used. The inner surface of the vessel 1 was coated with the three-wavelength bands fluorescent material of daylight color. The drop 2 of mercury was put in the vessel 1, and the partial pressure of the neon gas was set to 8 Torr. The shortest distance between the electrodes 4a and 4b was set to about 1 mm. The electrode 4 was formed in such a way that the ITO film was used and the silver paste of small width was applied as the power supply part to the ITO film in a strip and along the axial direction of the vessel 1. The dimension of the electrode 4 was set to 25 mmϕ×400 mm. Then, the voltage of the power source 10 was changed while keeping the voltage of the power source 9 at a suitable level, thereby to obtain the data represented by the mark x in FIG. 5. In a third case, the discharge device shown in FIG. 2 was used wherein the outer surface of the vessel 1 was coated with the silver paste baked thereon to form the electrodes 4a and 4b. In the same manner as that in the above-mentioned second case, the tube which is used in the normal neon filled fluorescent lamp of 15 W type was used as the vessel 1, and the inner surface of the vessel 1 was coated with the three-wavelength bands fluorescent material of daylight color. Moreover, in the same manner as that in the above second case, the drop 2 of mercury was put in the vessel 1 and the partial pressure of the neon gas was set to 8 Torr. The distance between the electrodes 4a and 4b was set to the range of 1 to 2 mm. The widths of the electrodes 4a and 4b were set to a relative small value, so that the entire peripheral surface of the vessel 1 was not covered with the electrodes 4a and 4b but a part of the entire peripheral surface was covered therewith. The lengths of the electrodes 4a and 4b along the axial direction of the vessel 1 were set to 380 mm. Then, the voltage of the power source 10 was changed while keeping the voltage of the power source 9 being at a suitable level, thereby to obtain the data represented by the mark Δ in FIG. 5. From FIG. 5, it is clearly understood that the luminous color of the discharge tube is changed.

Figure 6:
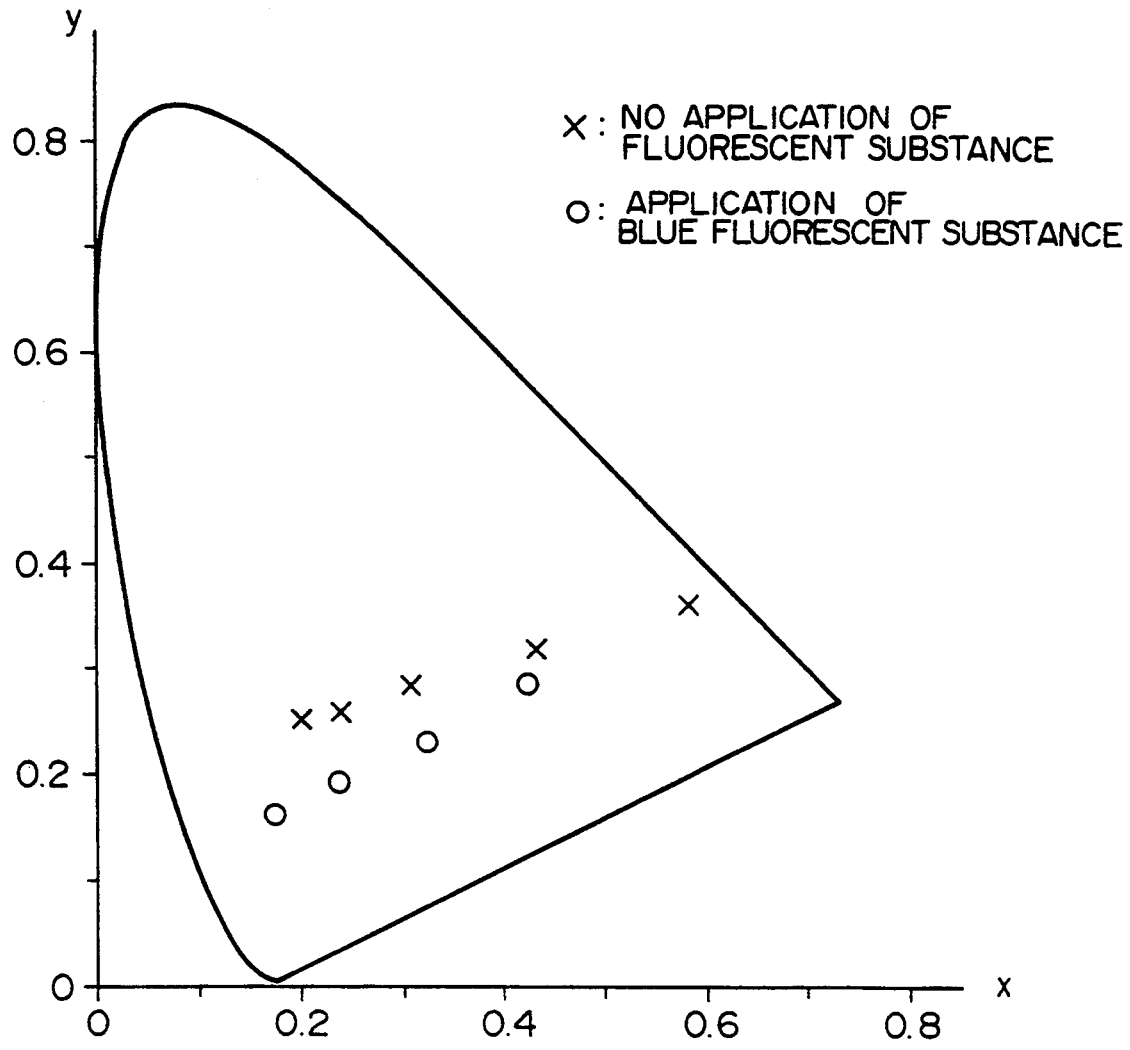
FIG. 6 is a CIE chromaticity diagram showing another example of characteristics of the discharge device according to the present invention.

FIG. 6 is a CIE chromaticity diagram showing another example of characteristics of the discharge device according to the present invention. All of the characteristics were obtained by using the discharge device shown in FIG. 4. The vessel 1 was made of glass, and the outer diameter and the inner diameter were set to 14 mmϕ and 12 mmϕ, respectively. A sufficient amount of mercury drop 2 was put in the vessel 1. The partial pressure of the neon gas was set to 20, 40 and 80 Torr in sequence. The shortest distance between the electrodes 4a and 4b was set to 1 mm. The lengths of the electrodes 4a and 4b along the axial direction of the vessel 1 were set to 110 mm. The shortest distance between the electrodes 3a and 3b was set to 140 mm. An aluminum foil was used to form the electrodes 3a, 3b and the electrodes 4a, 4b. The data shown in FIG. 6 was obtained with respect to a first case where a blue fluorescent substance was applied to a part of the inner surface of the vessel 1 corresponding in position to the electrodes 4a and 4b (about half of the entire periphery of the inner surface of the vessel 1), and a second case where the fluorescent substance was not applied to the inner surface of the vessel 1. The voltage of the power source 10 was changed while keeping the voltage of the power source 9 at a suitable level, thereby to obtain the data shown in FIG. 6. As the power source 10, a power source which had a frequency of 20 kHz and the maximum output voltage of 1200 V was used. From FIG. 6, it is clearly understood that the luminous color of the discharge tube is changed. Incidentally, in the case where the partial pressure of the neon gas was set to the range of 20 to 80 Torr, it was found that a remarkable change in the luminous color of the discharge tube was not shown.

It is to be understood that the present invention is not limited to the embodiments as has been described.

For example, in the present invention, the electrodes 4, 4*a* and 4*b* may be provided on the inner surface of the vessel 1. In this case, in order to prevent that the electrodes 4, 4*a* and 4*b* are damaged by the ion impulse, and the so-called "series discharge" is generated which spreads from the electrode 3*a* to the electrode 3*b* through the electrodes 4, 4*a* and 4*b*, it is preferable that the electrodes 4, 4*a* and 4*b* are coated with an insulating coating such as alumina coating.

Moreover, the number of electrodes constituting the first electrode unit, and the number of electrodes constituting the second electrode unit are not limited. For example, the electrode 4 may be divided into a plurality of electrode elements with respect to the axial direction of the vessel 1 to leave spaces among them.

The filled gases which are filled in the vessel 1 are not limited to the combination of the mercury vapor and the neon gas. That is, in the present invention, any other combination may be available as long as the filled gases include two kinds of gases which are different in excitation level and luminous color from each other.

Further, in the present invention, the filled gases which are filled in the vessel 1 do not necessarily include two kinds of gases which are different in excitation level and luminous color from each other. For example, the filled gases may include two kinds of gases which are different in excitation level and wavelength of radiated ultraviolet rays from each other. In this case, the filled gases may include the mercury vapor and the xenon gas for example. The excitation level of the mercury vapor is lower than that of the xenon gas.

In this case, the vessel 1 is previously coated with a first fluorescent substance for converting mainly ultraviolet rays (the wavelength of the main component is near 253.7 nm) radiated from the mercury vapor into first visible rays, and a second fluorescent substance for converting mainly ultraviolet rays (the wavelength of the main component is near 145 nm) into second visible rays which are different in wavelength from the first visible rays. The present discharge tube is different from those of the above-mentioned embodiments in that in the present discharge tube, the ultraviolet rays radiated from the mercury vapor are converted into the first visible rays by the first fluorescent substance and also the ultraviolet rays radiated from the xenon gas are converted into the second visible rays by the second fluorescent substance, whereas the above-mentioned embodiments depend on that the mercury vapor and the neon gas radiate directly the visible rays. However, the principle of changing the luminous color of the discharge tube is common to both the discharge tubes.

Moreover, in the case where the filled gases include mercury vapor and a xenon gas for example, the vessel 1 may be coated with a first fluorescent substance for converting ultraviolet rays radiated from the mercury vapor mainly into first visible rays, and a second fluorescent substance for converting ultraviolet rays radiated from both the mercury vapor and the xenon gas mainly into second visible rays which are different in wavelength from the first visible rays. The present discharge tube is different from those of the above-mentioned embodiments in that in the present discharge tube, the ultraviolet rays radiated from the mercury vapor are converted into the first visible rays by the first fluorescent substance and also the ultraviolet rays radiated from both the mercury vapor and the xenon gas are converted into the second visible rays by the second fluorescent substance, whereas the above embodiments depend on that the mercury vapor and the neon gas radiate directly the visible rays. However, the principle of changing the luminous color of the discharge tube is common to both the discharge tubes.

Further, for example, the filled gases may include two kinds of gases which are different in excitation level from each other. In this connection, one gas radiates mainly visible rays and the other gas radiates mainly ultraviolet rays. In this case, the filled gases may include a neon gas and a xenon gas for example. The neon gas radiates mainly the visible rays and the xenon gas radiates mainly the ultraviolet rays. In this case, the vessel 1 is coated with a fluorescent substance for converting the ultraviolet rays radiated from the xenon gas into the visible rays of which wavelength is different from that of the visible rays radiated from the neon gas. The present discharge tube is different from those of the above-mentioned embodiments in that the present discharge tube depends on that the neon gas radiates mainly the visible rays directly, and also in the present discharge tube, the ultraviolet rays radiated from the xenon gas are converted into the visible rays by the fluorescent substance, whereas the above-mentioned embodiments depend on that the mercury vapor and the neon gas radiate the visible rays directly. However, the principle of changing the luminous color of the discharge tube is common to both the discharge tubes.

As set forth hereinabove, according to the present invention, the luminous color can be changed by utilizing the negative glow positively. Moreover, there is no need for changing the width, period, rise time and the like of the pulse by utilizing the pulsed discharge.

We claim:

1. A discharge tube comprising:

a tubular vessel;

filled gases filled in said vessel and including a first gas and a second gas, said first and second gases being different in excitation level and luminous color from each other;

first electrode means for applying axially an electric field to said vessel to generate a positive column in said vessel; and second electrode means for applying an electric field to said vessel to generate a negative glow in an area, said area extending substantially along a wall surface of said vessel and interacting with said positive column generated by the electric field applied by said first electrode means.

2. A discharge tube according to claim 1, wherein an excitation level of said first gas is lower than that of said second gas, and a partial pressure of said first gas is lower than that of said second gas.

3. A discharge tube according to claim 1, wherein said first gas is mercury vapor, and said second gas is a neon gas.

4. A discharge tube according to claim 3, wherein the partial pressure of said first gas is in the range of $10^{-4}$ to 1 Torr, and the partial pressure of said second gas is in the range of 1 to 100 Torr.

5. A discharge tube according to claim 1, wherein a part of said vessel is at least light-transmissive which corresponds in position to said positive column generated by the electric field applied by said first electrode means.

6. A discharge tube according to claim i, wherein an inner surface of said vessel is coated with a fluorescent substance for converting ultraviolet rays radiated from said first gas and/or said second gas into visible rays.

7. A discharge tube according to claim 1, wherein said first electrode means includes at least two first electrodes, and said second electrode means includes at least two second electrodes.

8. A discharge tube according to claim 7, wherein one of said at least two first electrodes and one of said at least two second electrodes are used in common as a single electrode.

9. A discharge tube according to claim 7, wherein said at least two first electrodes are provided independently of said at least two second electrodes.

10. A discharge tube according to claim 7, wherein the shortest distance between said at least two first electrodes is at least 1 mm.

11. A discharge tube according to claim 7, wherein the shortest distance between said at least two second electrodes is in the range of 0.1 mm to 20 cm.

12. A discharge tube according to claim 7, wherein said at least two first electrodes are provided in said vessel.

13. A discharge tube according to claim 7, wherein said at least two first electrodes are provided on an outer surface of said vessel.

14. A discharge tube according to claim 7, wherein at least one of said at least two second electrodes is provided in said vessel, and the rest of said at least two second electrodes is provided on an outer surface of said vessel.

15. A discharge tube according to claim 7, wherein at least one of said at least two second electrodes is provided on an inner surface of said vessel, and the rest of said at least two second electrodes is provided on an outer surface of said vessel.

16. A discharge tube according to claim 7, wherein said at least two second electrodes are provided on an outer surface of said vessel.

17. A discharge tube according to claim 7, wherein said at least two second electrodes are provided on an inner surface of said vessel.

18. A discharge tube according to claim 7, wherein said at least two second electrodes are light-transmissive.

19. A discharge tube according to claim 7, wherein said at least two second electrodes are made of metal.

20. A discharge tube according to claim 19, wherein said at least two second electrodes are provided in such a way that all of rays which are radiated from said positive column generated by the electric field applied by said first electrode means to the outside, and all of rays which are radiated from said negative glow generated in said area confronting said positive column to the outside are not blocked off.

21. A discharge device having a discharge tube, said discharge tube including:

a tubular vessel;

filled gases filled in said vessel and including a first gas and a second gas, said first and second gases being different in excitation level and luminous color from each other;

first electrode means for applying axially an electric field to said vessel to generate a positive column in said vessel; and second electrode means for applying an electric field to said vessel to generate a negative glow in an area, said area extending substantially along a wall surface of said vessel and interacting with said positive column generated by the electric field applied by said first electrode means, said discharge device further including a power unit, and control means for controlling power supply from said power unit to said first electrode means and said second electrode means.

22. A discharge device according to claim 21, wherein said control means selects at least two states out of a state in which only said first electrode means is supplied with the electric power, a state in which only said second electrode means is supplied with the electric power, and a state in which both said first electrode means and said second electrode means are supplied with the electric power.

23. A discharge device according to claim 21, wherein said power unit supplies the electric power which has one or two frequencies to said first electrode means and said second electrode means.

24. A discharge tube comprising:

a tubular vessel;

filled gases filled in said vessel and including a first gas and a second gas, said first and second gases being different in excitation level and wavelength of radiated ultraviolet rays from each other;

first electrode means for applying axially an electric field to said vessel to generate a positive column in said vessel; and second electrode means for applying an electric field to said vessel to generate a negative glow in an area, said area extending substantially along a wall surface of said vessel and interacting with said positive column generated by the electric field applied by said first electrode means, wherein an inner surface of said vessel is coated with a first fluorescent substance for converting mainly ultraviolet rays radiated from said first gas into first visible rays, and a second fluorescent substance for converting mainly ultraviolet rays radiated from said second gas into second visible rays which are different in wavelength from said first visible rays.

25. A discharge tube according to claim 24, wherein said first gas is mercury vapor, and said second gas is a xenon gas.

26. A discharge tube comprising:

a tubular vessel;

filled gases filled in said vessel and including a first gas and a second gas, said first and second gases being different in excitation level and wavelength of radiated ultraviolet rays from each other;

first electrode means for applying axially an electric field to said vessel to generate a positive column in said vessel; and second electrode means for applying an electric field to said vessel to generate a negative glow in an area, said area extending substantially along a wall surface of said vessel and interacting with said positive column generated by the electric field applied by said first electrode means, wherein an inner surface of said vessel is coated with a first fluorescent substance for converting mainly ultraviolet rays radiated from said first gas into first visible rays, and a second fluorescent substance for converting the ultraviolet rays radiated from both said first and second gases into second visible rays which are different in wavelength from said first visible rays.

27. A discharge tube according to claim 26, wherein said first gas is mercury vapor, and said second gas is a xenon gas.

28. A discharge tube comprising:

a tubular vessel;

filled gases filled in said vessel and including a first gas and a second gas, said first and second gases being different in excitation level from each other, said first gas radiating mainly visible rays, said second gas radiating mainly ultraviolet rays;

first electrode means for applying axially an electric field to said vessel to generate a positive column in said vessel; and second electrode means for applying an electric field to said vessel to generate a negative glow in an area, said area extending substantially along a wall surface of said vessel and interacting with said positive column generated by the electric field applied by said first electrode means, wherein an inner surface of said vessel is coated with a fluorescent substance for converting said ultraviolet rays radiated from said second gas into visible rays which are different in wavelength from said visible rays radiated from said first gas.

29. A discharge tube according to claim 28, wherein said first gas is a xenon gas, and said second gas is a neon gas.

* * * * *